United States Patent [19]

Stephan

[11] Patent Number: 5,038,509

[45] Date of Patent: Aug. 13, 1991

[54] COMBINATION MAGAZINE RECEIVER MAGAZINE AND BORE GUN BRUSH

[76] Inventor: Gerard A. Stephan, 11 Oak Pl., Seldon, N.Y. 11784

[21] Appl. No.: 656,209

[22] Filed: Feb. 15, 1991

[51] Int. Cl.[5] ..... F41A 29/02

[52] U.S. Cl. ..... 42/95; 15/104.16

[58] Field of Search ..... 42/95, 90, 96; 15/104.16, 104.165, 106, 107, 110, 111, 114, 117, 160, 164

[56] References Cited

U.S. PATENT DOCUMENTS

| | | | |
|---|---|---|---|
| 1,015,915 | 1/1912 | Strickler | 42/95 |
| 1,175,256 | 3/1916 | Gruver | 42/95 |
| 1,556,494 | 10/1925 | Cooper | 42/95 |
| 4,038,715 | 8/1977 | Litt | 15/106 |
| 4,674,218 | 6/1987 | Bottomley | 42/95 |
| 4,949,496 | 8/1990 | Stephan | 42/90 |

*Primary Examiner*—Charles T. Jordan

*Attorney, Agent, or Firm*—Michael I. Kroll

[57] ABSTRACT

A gun brush is provided for cleaning a magazine receiver, magazine and bore in a barrel of a pistol. The gun brush consists of an elongated handle to be gripped by the hand of a person using the gun brush. A first head segment is on a first end of the handle. A mechanism on the first head segment is for cleaning the magazine receiver and the magazine of the pistol. A second head segment is on a second end of the handle. A mechanism on the second head segment is for cleaning the bore in the barrel of the pistol.

12 Claims, 1 Drawing Sheet

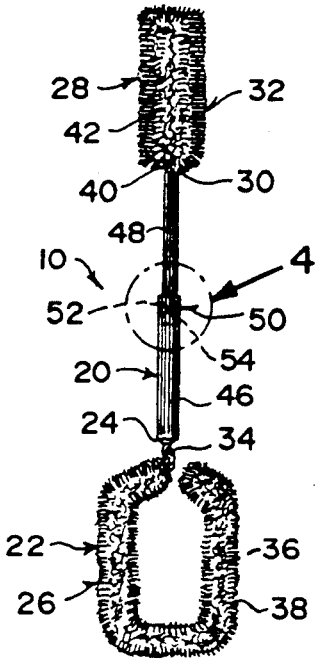
Fig. 1
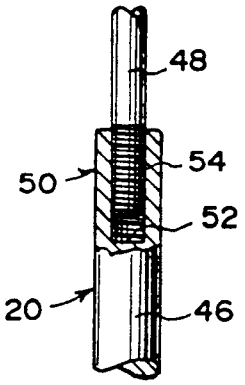
Fig. 4
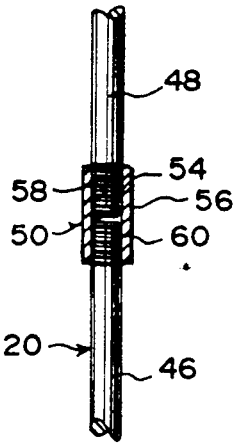
Fig. 5
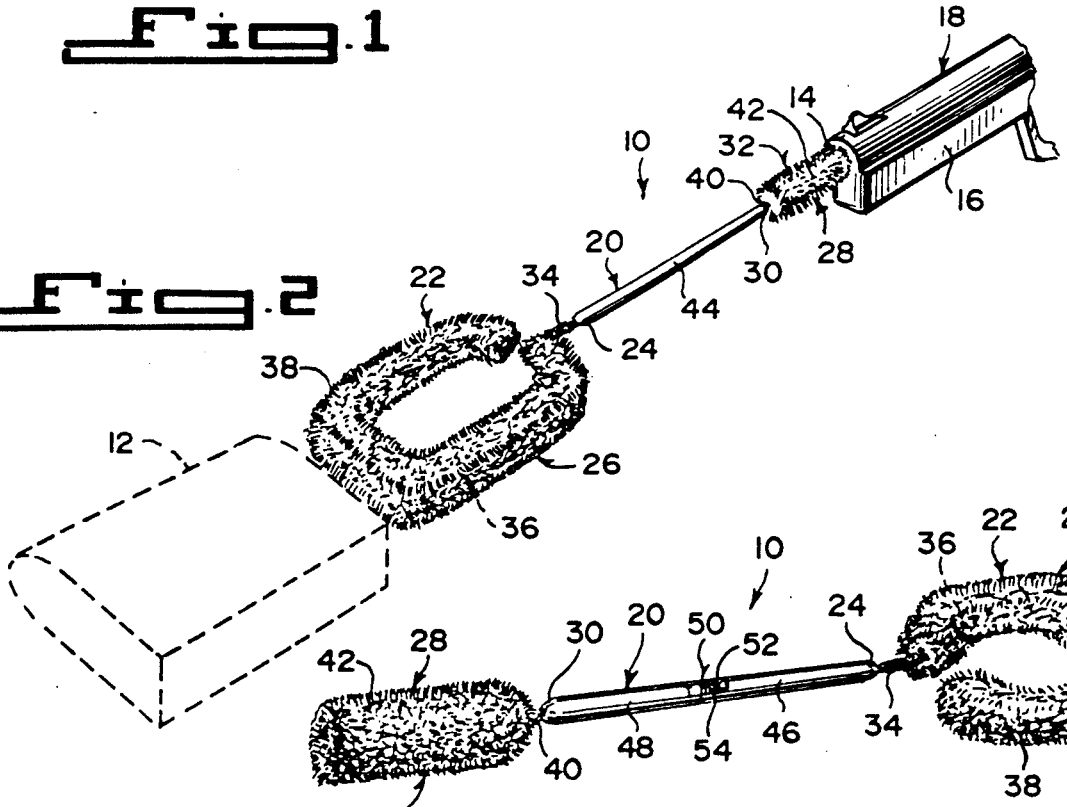
Fig. 2
Fig. 3

COMBINATION MAGAZINE RECEIVER MAGAZINE AND BORE GUN BRUSH

BACKGROUND OF THE INVENTION

1. Field of the Invention

The instant invention relates generally to firearm maintenance accessories and more specifically it relates to a combination magazine receiver, magazine and bore gun brush.

2. Description of the Prior Art

Numerous firearm maintenance accessories have been provided in prior art that are adapted to clean and maintain firearms, such as pistols, revolvers, rifles and the like. While these units may be suitable for the particular purpose to which they address, they would not be as suitable for the purposes of the present invention as heretofore described.

SUMMARY OF THE INVENTION

A primary object of the present invention is to provide a combination magazine receiver, magazine and bore gun brush that will overcome the shortcomings of the prior art devices.

Another object is to provide a combination magazine receiver, magazine and bore gun brush that includes a handle having double head segments with bristles in which on head segment is sized to fit into and clean the magazine receiver and the magazine while the other head segment is sized to fit into and clean the bore of the pistol barrel.

An additional object is to provide a combination magazine receiver, magazine and bore gun brush in which the handle is divided into two segments that are removably attached to each other.

A further object is to provide a combination magazine receiver, magazine and bore gun brush that is simple and easy to use.

A still further object is to provide a combination magazine receiver, magazine and bore gun brush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a top view of a first embodiment of the instant invention.

FIG. 2 is a perspective view of a second embodiment of the instant invention ready to clean the bore of a pistol barrel or a magazine.

FIG. 3 is a perspective view of a third embodiment of the instant invention.

FIG. 4 is an enlarged view as indicated by arrow 4 in FIG. 1 with parts broken away and in section showing the connecting mechanism in greater detail.

FIG. 5 is an enlarged view similar to FIG. 4 showing another connecting mechanism in greater detail.

DETAILED DESCRIPTION OF THE PREFERRED EMBODIMENTS

Turning now descriptively to the drawings, in which similar reference characters denote similar elements throughout the several views, the Figures illustrate a gun brush 10 for cleaning a magazine receiver (not shown), magazine 12 and bore 14 in a barrel 16 of a pistol 18. The gun brush 10 consists of an elongated handle 20 to be gripped by the hand of a person using the gun brush 10. A first head segment 22 is on a first end 24 of the handle 20. A mechanism 26 is on the first head segment 22 for cleaning the magazine receiver and the magazine 12 of the pistol 18. A second head segment 28 is on a second end 30 of the handle 20. Mechanism 32 is on the second head segment 28 for cleaning the bore 14 in the barrel 16 of the pistol 18.

The first head segment 22 includes a pair of twisted wires in the shape of a stem 34 terminating in an open ended loop 36, whereby the end of the stem 34 is attached to the first end 24 of the handle 20.

The first cleaning mechanism 26 includes a plurality of bristles 38 extending radially from the open ended loop 36 of the first head segment 22.

The second head segment 28 includes a pair of twisted wires in the shape of a straight extending stem 40, whereby the end of the straight stem 40 is attached to the second end 30 of the handle 20. The second cleaning mechanism 32 includes a plurality of bristles 42 extending radially from the straight extending stem 40.

As shown in FIG. 2, the handle 20 is a unitary cylindrical shaft 44, while in all the other figures the handle 20 is divided into two cylindrical shaft segments 46 and 48. A mechanism 50 is for removably attaching the two shaft segments 46 and 48 together so that the person can grip the handle 20 for cleaning. The shaft segments 46 and 48 in FIGS. 1 and 4 are of different diameters, while the shaft segments 46 and 48 in FIGS. 3 and 5 are of equal diameters.

The removable attaching mechanism 50 in FIGS. 1 and 4 includes the large diameter shaft segment 46 having an internally threaded hole 52 at the distal end thereof. The small diameter shaft segment 48 has an externally threaded end 54 which can engage with the internally threaded hole 52 in the large diameter shaft 46.

The removable attaching mechanism 50 in FIG. 5 includes a collar 56 having an internally threaded hole 58 therethrough. The first shaft segment 46 having an externally threaded end 60 which can engage with the internally threaded hole 58 in the collar 56. The second shaft segment 48 has the externally threaded end 54 which can engage with the internally threaded hole 58 in the collar 56 opposite from the first shaft segment 46.

The removable attaching mechanism 50 in FIG. 3 includes the first shaft segment 46 having the internally threaded hole 52 at the distal end thereof. The second shaft segment 48 has the externally threaded end 54 which can engage with the internally threaded hole 52 in the first shaft segment 46.

To use the gun brush 10 a person can grip the elongated handle 20 and insert the first head segment 22 with the first cleaning mechanism 26 into the magazine receiver of the pistol 18 or the magazine 12 and by moving the first head segment 22 in and out, the person can clean the magazine receiver or the magazine 12. The person can also insert the second head segment 28 with the second cleaning mechanism 32 into the bore 14 of the barrel 16 in the pistol 18. By moving the second head segment 28 in and out, the person can clean the bore 14 of the barrel 16.

LIST OF REFERENCE NUMBERS

10 gun brush
12 magazine
14 bore
16 barrel
18 pistol
20 elongated handle
22 first head segment
24 first end of 20
26 first cleaning mechanism on 22
28 second head segment
30 second end of 20
32 second cleaning mechanism on 28
34 twisted wire stem on 22
36 open ended loop
38 bristles of 26
40 twisted wire straight extending stem on 28
42 bristles of 32
44 unitary cylindrical shaft of 20
46 first cylindrical shaft segment of 20
48 second cylindrical shaft segment of 20
50 removable attaching mechanism
52 internally threaded hole in 46
54 externally threaded end on 48
56 collar
58 internally threaded hole in 56
60 externally threaded end on 46

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A gun brush for cleaning a magazine receiver, magazine and bore in a barrel of a pistol, said gun brush comprising:

a) an elongated handle to be gripped by the hand of a person using said gun brush;
b) a first head segment on a first end of said handle;
c) means on said first head segment for cleaning the magazine receiver and the magazine of the pistol;
d) a second head segment on a second end of said handle; and
e) means on said second head segment for cleaning the bore in the barrel of the pistol.

2. A gun brush as recited in claim 1, wherein said first head segment includes a pair of twisted wires in the shape of a stem terminating in an open ended loop, whereby the end of said stem is attached to the first end of said handle.

3. A gun brush as recited in claim 2, wherein said first cleaning means includes a plurality of bristles extending radially from said open ended loop of said first head segment.

4. A gun brush as recited in claim 3, wherein said second head segment includes a pair of twisted wires in the shape of a straight extending stem, whereby the end of said straight stem is attached to the second end of said handle.

5. A gun brush as recited in claim 4, wherein said second cleaning means includes a plurality of bristles extending radially from said straight extending stem.

6. A gun brush as recited in claim 5, wherein said handle is a unitary cylindrical shaft.

7. A gun brush as recited in claim 5, further including:

a) said handle divided into two cylindrical shaft segments; and
b) means for removable attaching said two shaft segments together so that the person can grip said handle for cleaning.

8. A gun brush as recited in claim 7, wherein said shaft segments are of different diameters.

9. A gun brush as recited in claim 7, wherein said shaft segments are of equal diameters.

10. A gun brush as recited in claim 8, wherein said removable attaching means includes:

a) said large diameter shaft segment having an internally threaded hole at the distal end thereof; and
b) said small diameter shaft segment having an externally threaded end which can engage with said internally threaded hole in said large diameter shaft.

11. A gun brush as recited in claim 9, wherein said removable attaching means includes:

a) a collar having an internally threaded hole therethrough;
b) said first shaft segment having an externally threaded end which can engage with said internally threaded hole in said collar; and
c) said second shaft segment having an externally threaded end which can engage with said internally threaded hole in said collar opposite from said first shaft segment.

12. A gun brush as recited in claim 9, wherein said removable attaching means includes:

a) said first shaft segment having an internally threaded hole at the distal end thereof; and
b) said second shaft segment having an externally threaded end which can engage with said internally threaded hole in said first shaft segment.

* * * * *